US008157949B2

(12) United States Patent
Kim

(10) Patent No.: US 8,157,949 B2
(45) Date of Patent: Apr. 17, 2012

(54) METHOD OF DURABLY GRAFTING A DECORATED FABRIC TO A CLOTH SUCH AS JEANS WITH STENCIL

(76) Inventor: Inkyun Kim, Arcadia, CA (US)

( * ) Notice: Subject to any disclaimer, the term of this patent is extended or adjusted under 35 U.S.C. 154(b) by 120 days.

(21) Appl. No.: 12/313,795

(22) Filed: Nov. 25, 2008

(65) Prior Publication Data

US 2011/0005663 A1 Jan. 13, 2011

(51) Int. Cl.

| | |
|---|---|
| ***B29C 65/00*** | (2006.01) |
| ***B32B 37/00*** | (2006.01) |
| ***B32B 38/14*** | (2006.01) |
| ***B32B 27/00*** | (2006.01) |
| ***C09J 5/04*** | (2006.01) |

(52) U.S. Cl. ..... 156/277; 156/314; 156/333

(58) Field of Classification Search ..... 561/155, 561/230, 234, 235, 237, 239, 240, 241, 247, 561/249; 156/60, 63, 148, 250, 256, 258, 156/264, 265, 277, 297, 299, 307.1, 307.3, 156/307.5, 307.7, 310, 314, 318, 325, 326, 156/327, 333

See application file for complete search history.

(56) References Cited

U.S. PATENT DOCUMENTS

| | | | | |
|---|---|---|---|---|
| 4,209,565 | A * | 6/1980 | Davis et al. | 428/347 |
| 4,410,575 | A * | 10/1983 | Obayashi et al. | 428/57 |
| 4,860,387 | A | 8/1989 | Williams | |
| 5,087,664 | A | 2/1992 | Sugino | |
| 5,758,588 | A | 6/1998 | Orfali | |

* cited by examiner

*Primary Examiner* — Philip Tucker
*Assistant Examiner* — Brian R Slawski

(57) ABSTRACT

A method of durably grafting a decorated cotton fabric to a cotton clothing such as jeans or denim is comprised of; 1) first step of printing a pattern with first stencil on a clothing that covers a supporting plate of an automatic printing machine, 2) second step of pasting an alkali solution along the outer line of the pattern on the clothing with second stencil, 3) third step of pasting a grafting glue along the outer line of the pattern on the clothing with third stencil, 4) fourth step of pasting a water-soluble glue on one side of a fabric, 5) fifth step of pasting a burn out gel on fourth stencil that is overlapped over the fabric attached clothing, 6) sixth step of taking out the fabric attached clothing from the supporting plate of the automatic printing machine and drying the fabric attached clothing on a dryer at 160 ° C. over 2 minutes, 7) seventh step of heating and pressing the fabric attached clothing between a heating press and press longer than 5 minutes at 160 ° C. The left over of the burn out from the grated fabric can be removed by washing with washing machine. This technology can be applied to other artificial fabrics.

8 Claims, 11 Drawing Sheets

METHOD OF DURABLY GRAFTING A DECORATED FABRIC TO A CLOTH SUCH AS JEANS WITH STENCIL

FIELD OF THE INVENTION

Current application relates to a method of durably grafting fabrics each other, especially relates to a method of durably grafting a decorated fabric to a clothing such as blue jeans made of 100% cotton.

BACKGROUND OF THE INVENTION

Jeans, blue jeans, became a heritage of human culture representing youth culture. They spread throughout the whole world and every youngster already has at least one of it or wants to have one. Now, jeans take a big portion in fashion industry. Recently, many kind of technologies are introduced to decorate jeans to meet requirements of young customers. However, due to the characteristics of the material, 100% cotton, method of decorating jeans are limited. Customers' requirement asking various different designs makes it more difficult. Printing might be the easiest way for decorating jeans with various designs. But, repeated washing deteriorates the drawings. Embroidering is the most durable and popular method of decorating the jeans. But, production cost for various designs is high. Gluing may be one of the cheap and convenient methods of grafting jeans with designed fabrics if it is durable. It is purpose of the current application to develop a method of durably gluing decorated fabrics to other cotton cloths such as blue jeans by applying many kind of materials as a gluing agent.

DESCRIPTION OF PRIOR ART

U.S. Pat. No. 5,758,588 to Orfali illustrates an applique such as a lace-trimming is grafted onto a region of a textile product, such as a towel or a pair of blue-jeans.

U.S. Pat. No. 4,860,387 to Williams illustrates a decorated garment (11) has a plurality of doll figures (12,13,14) mounted on its front surface. Articles of clothing (26) for each of the doll figures are adapted to be attached to the doll figures to provide decorative wardrobes for the doll figures.

U.S. Pat. No. 5,087,664 to Sugino, et al. Illustrates a plastisol composition comprising a vinyl chloride polymer, a plasticizer and an adhesion-imparting agent, characterized in that the adhesion-imparting agent is a diisocyanate polymer blocked with an oxybenzoic acid ester or with an alkylphenol and having an average molecular weight within a range of from 1,000 to 10,000.

None of the prior art illustrates a method of grafting 100% cotton fabric onto 100% cotton cloths such as blue jeans to produced a glued cotton wear durable over 1,000 times mechanical washing.

SUMMARY OF THE INVENTION

Jeans, blue jeans, became a heritage of human culture representing youth culture. Recently, many kind of technologies are introduced to decorate jeans to meet requirements of young customers. However, due to the characteristics of the material, 100% cotton, method of decoration jeans are limited. Printing might be the easiest way for decorating jeans with various designs. But, repeated washing deteriorates the drawings. Embroidering is the most durable and popular method of decorating the jeans. But, production cost for various designs is high. Gluing may be one of the cheap and convenient methods of grafting jeans with designed fabrics if it is durable. It is purpose of the current application to develop a method of durably gluing decorated fabrics to other cotton cloths such as blue jeans by applying many kind of materials as a gluing agents.

A method of durably grafting a decorated fabric to a cotton clothing such as jeans or denim is comprised of; 1) first step of printing a pattern with first stencil on a clothing that covers a supporting plate of an automatic printing machine, 2) second step of pasting an alkaline solution along the outer line of the pattern on the clothing with second stencil, 3) third step of pasting a grafting glue along the outer line of the pattern that is printed the clothing with third stencil, 4) fourth step of pasting a water-soluble glue on one side of a fabric, 5) fifth step of pasting a burn out gel on fourth stencil that is overlapped over the fabric attached clothing, 6) sixth step of taking out the fabric attached clothing from the supporting plate of the automatic printing machine and drying the fabric attached clothing on a dryer at 160° C. over 3 minute, 7) seventh step of heating and pressing the fabric attached clothing between a heating press and press longer than 5 seconds at 160° C.

BRIEF DESCRIPTION OF DRAWINGS

FIG. 1-2 is a schematic drawing of prior art of printing method utilizing stencil.

FIG. 1-3 is a schematic drawing of method of prior art producing a patterned fabric attached clothing utilizing a stencil of prior art.

FIG. 2 is a schematic drawing of printing a pattern on a clothing with first stencil according to current invention.

FIG. 3 is a schematic drawing of pasting an alkali solution along the outer-line of the pattern printed on the clothing utilizing a second stencil according to current invention.

FIG. 6-1 is a cross-sectional view of overlapped water-soluble glue sprayed fabric and grafting glue pasted along the outer-line of the pattern on the clothing according to the current invention showing the water-soluble glue covers larger area than the grafting glue to hold the fabric in position on the clothing.

FIG. 6-2 is a schematic drawing of pasting burnout gel on fourth stencil to cut out the fabric along the outer-line of the pattern formed on the fourth stencil.

DETAILED DESCRIPTION OF THE PREFERRED EMBODIMENT

Figure 1:
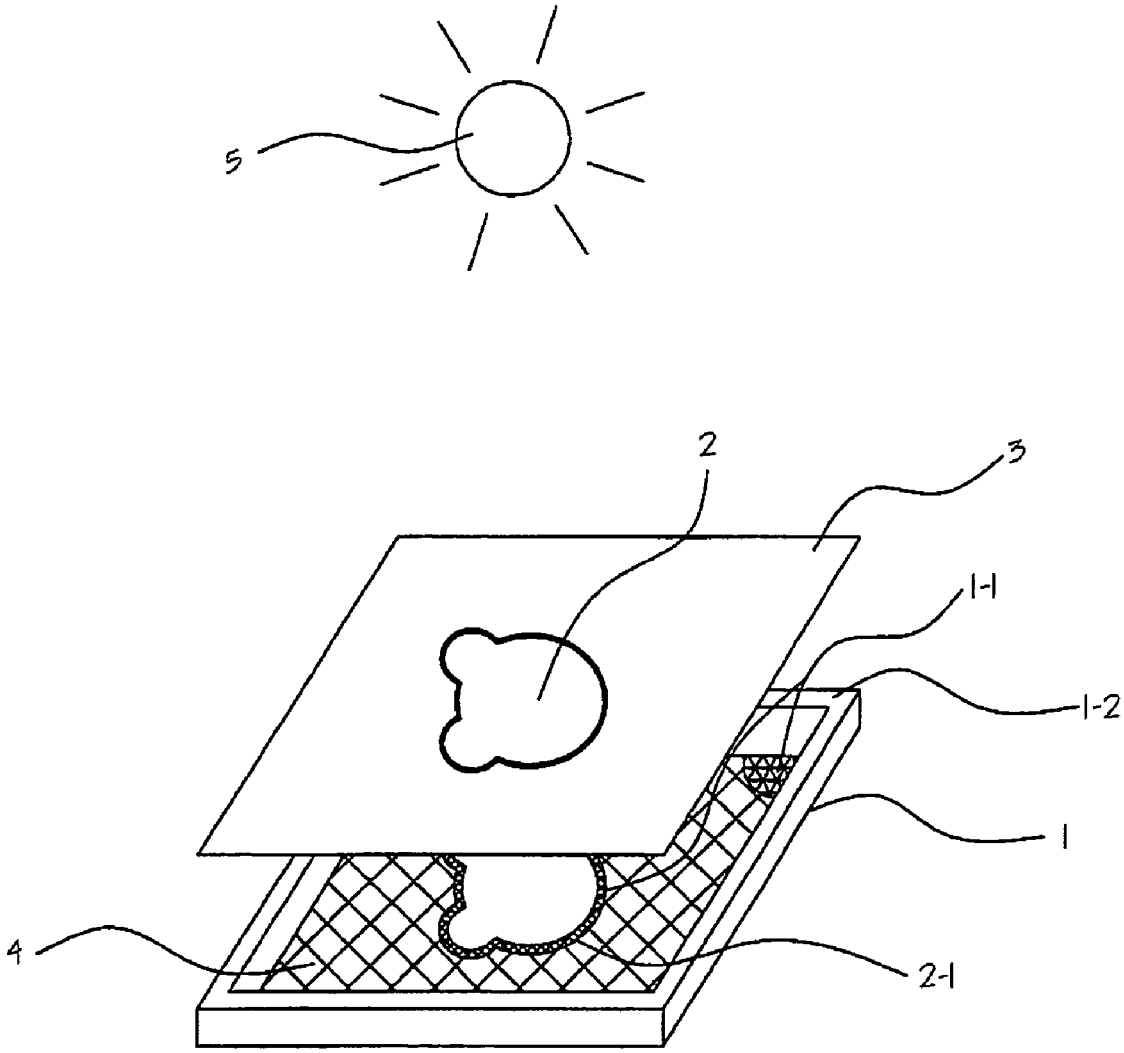
FIG. 1-1 Prior Art
FIG. 1-1 is a schematic drawing of method of producing a patterned stencil of prior art.

FIG. 1-1 is a schematic drawing of method of producing a patterned stencil (1) of prior art. The stencil (1) is usually comprised of screen (1-1) polyester of mesh size from 50 mesh to 100 mesh supported on a frame (1-2). Typical method is to draw a pattern (2) on a transparent film (3) of PET (Polyethylene Terephthalate). Then place the film (3) over a stencil (1), on which layer of light sensitive chemical (4) is pasted, and expose to a strong light (5). Then the pattern (2) is projected to the stencil (1) and forms a shadow (2-1) on the stencil (1). Then the light sensitive chemical (4) layer is hardened while the shadow (2-1) area remains unchanged. After wash out the unchanged chemical (4) layer, the screen (1-1) mesh is exposed from the shadow (2-1) area of FIG. 1-1. Such, pattern (2) containing, stencil (1) can be used for printing a clothing or cutting out patterns from fabrics.

Figures 1, 2:
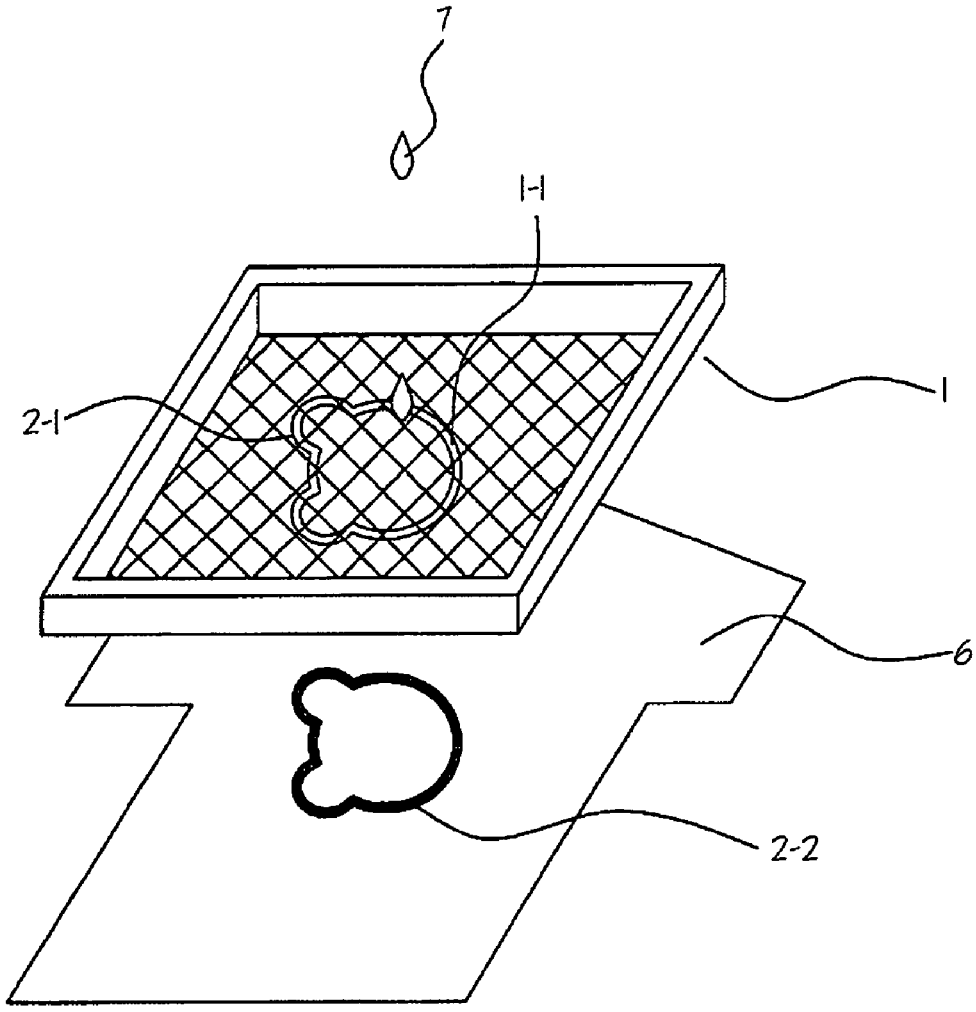
FIG. 1-2 Prior Art

FIG. 1-2 is a schematic drawing of prior art of printing method-utilizing stencil (1). For printing, desired ink (7) is applied to the pattern (2) containing stencil.

The ink (7) pass through the mesh (2-1) of the patterned area and print a patterned drawing (2-2) on a clothing (6). The printed clothing (6) can be used as a final product. However, the printed pattern (2-2) may fade out by repeated laundry. So, people think about attaching decorated fabrics to clothes by sewing the fabrics directly to the clothes.

Figures 1, 2, 3:
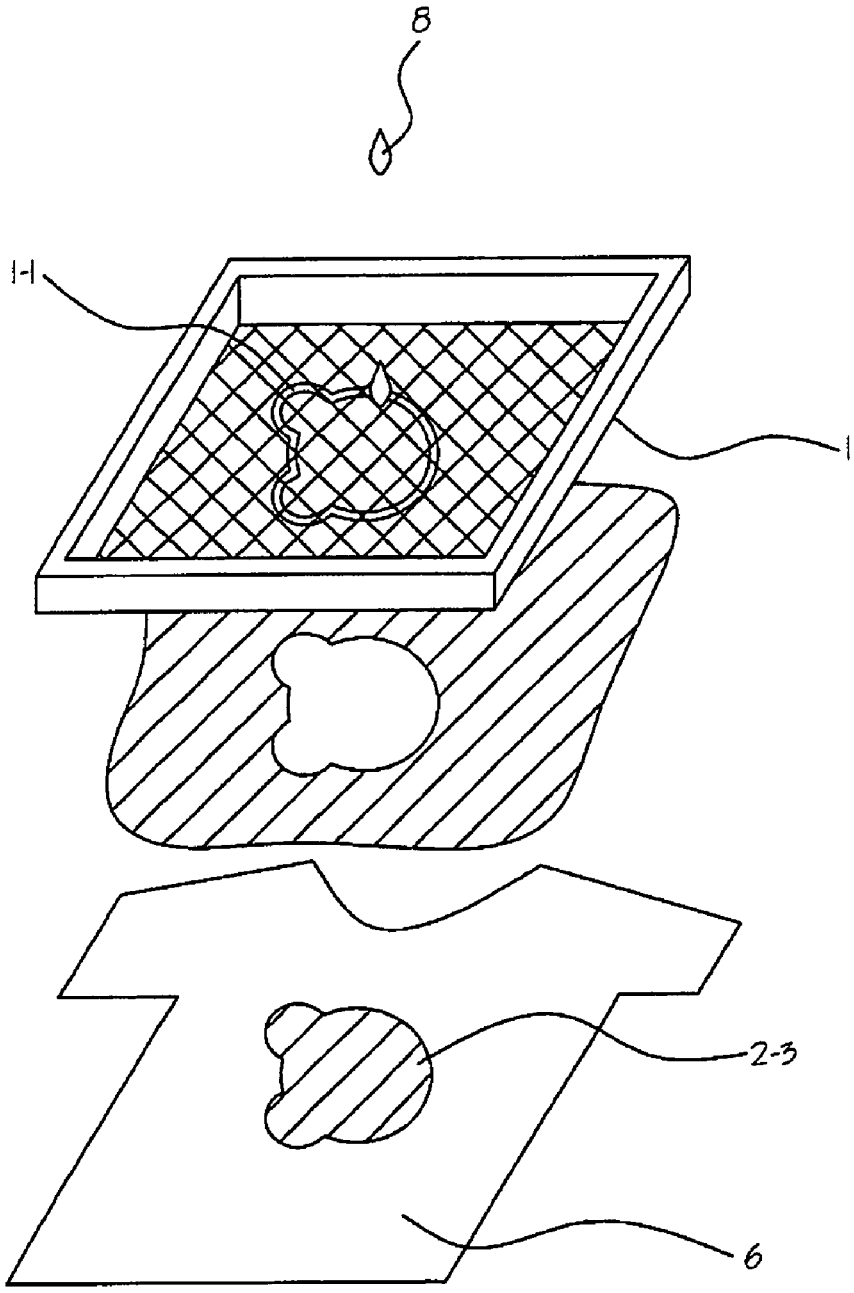
FIG. 1-3 Prior Art
Figure 2:
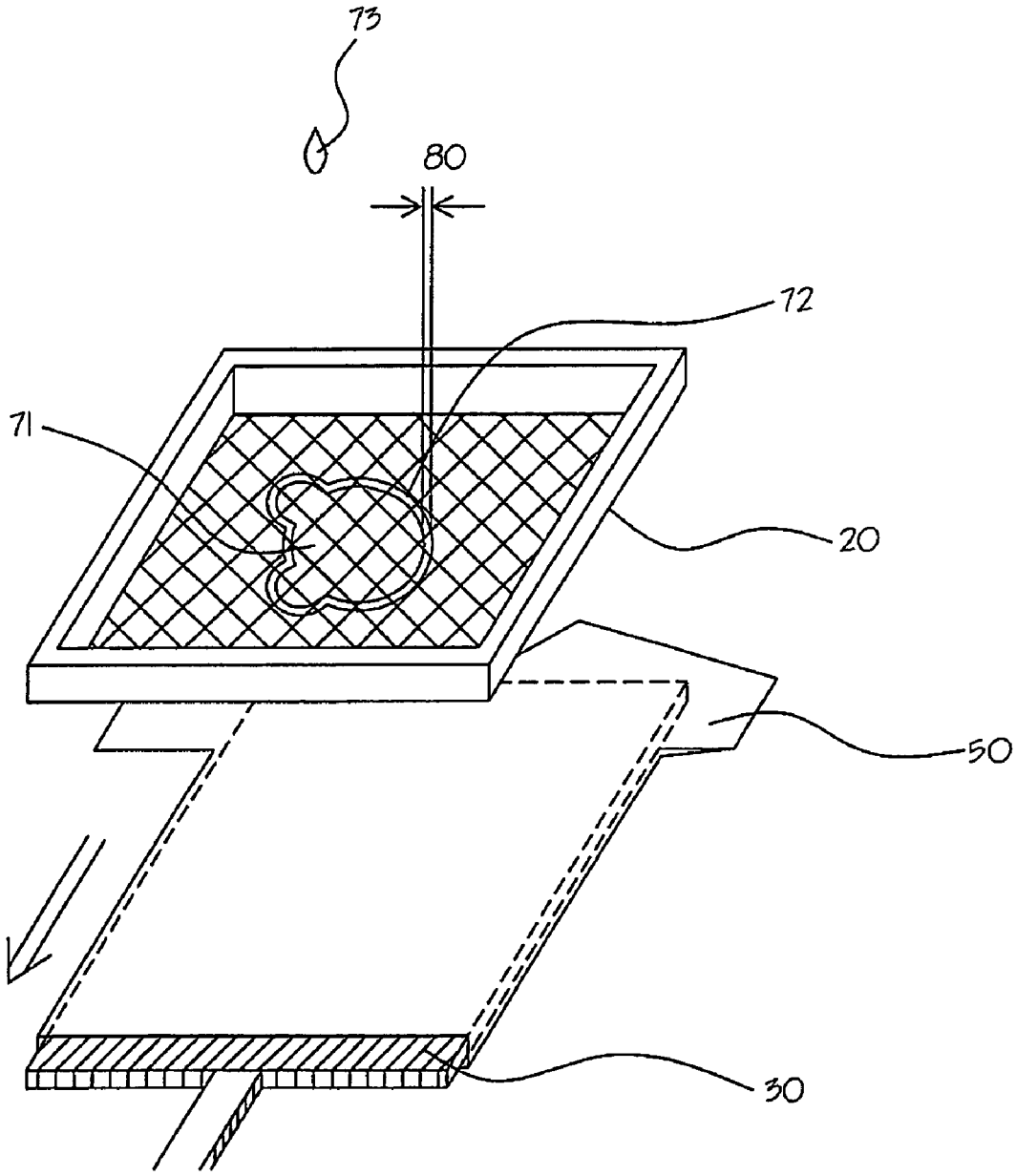
Figure 3:
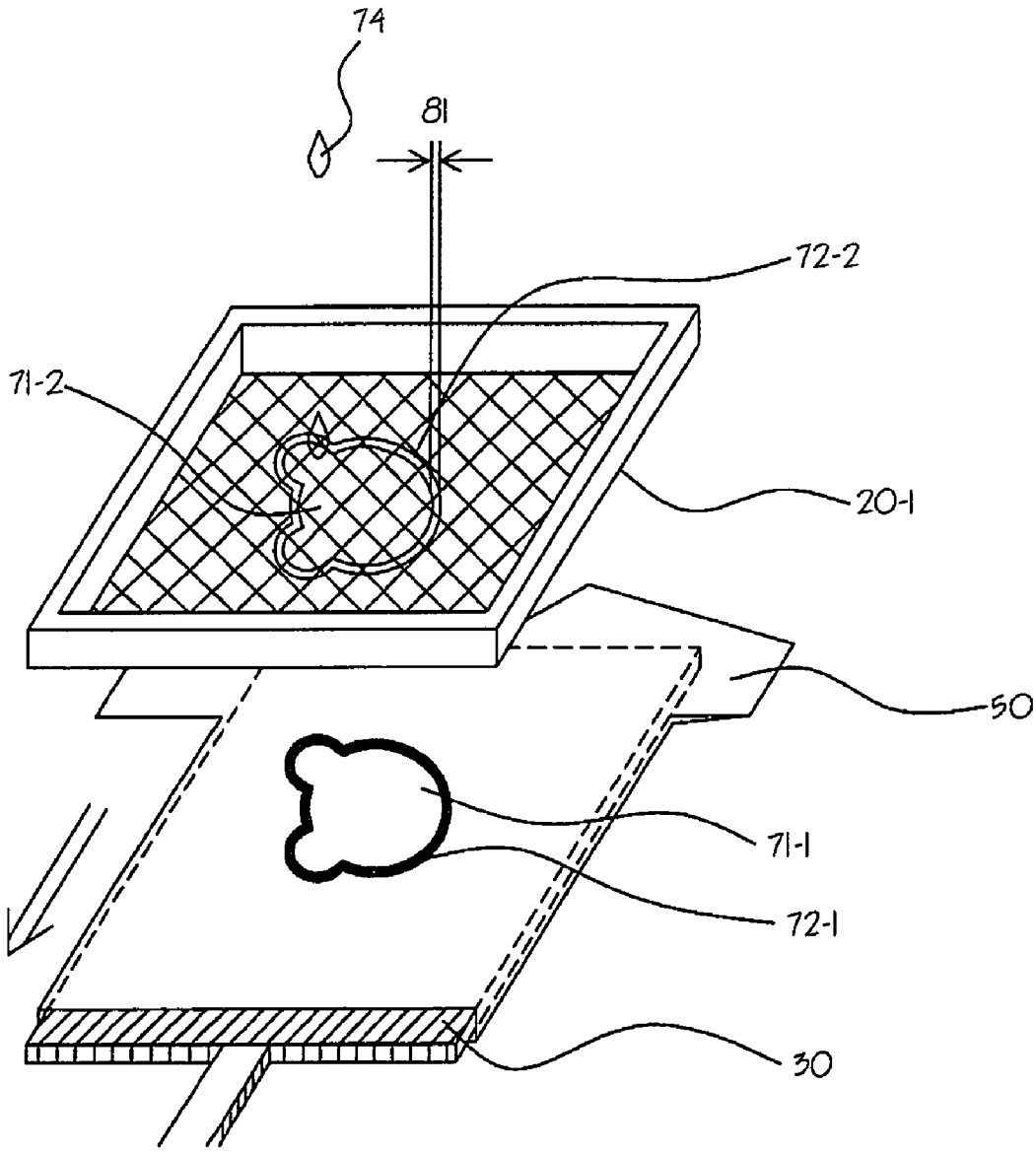

FIG. 1-3 is a schematic drawing of method of prior art producing a patterned fabric attached clothing utilizing a stencil of prior art. A bum out gel (8), which is a mixture of natural alginate, strong acid glycerin and water, is applied to the stencil (1) to cut patterned patch (2-3) out of a fabric. The cut out patch (2-3) is overlapped on the clothing (6), where a pattern which is same as the patch (2-3), is printed, and is adhered by proper method, sewing is typical. To sew the patch (2-3), the clothing (6) should be moved to a sewing machine. As described above, grafting clothing with patterned patch of fabric by previous method is very cumbersome job.

It is purpose of the current application to provide a simple method to manufacture a durably grafting decorated fabrics to a cotton clothing such as blue jeans by gluing. Then, all procedure can be finished with same machines. Difference of the current invention from the prior art the procedure of manufacturing a durably grafting decorated fabric to a cotton clothing is as follows; The first step is to print a pattern (71) on a clothing (50). The clothing (50) is made of, including but not limited to 100% cotton. FIG. 2 is a schematic drawing of printing a pattern (71) on a clothing (50). This step is same as the FIG. 1-2 prior art. An automatic printing machine was used for this invention. Pluralities of supporting plates (30) are connected to the automatic printing machine. One supporting plate (30) of the automatic printing machine is inserted to one clothing (50), which is to be printed, to hold the clothing (50) in position. First stencil (20) is overlapped on the clothing (50) and pasted with ink (73) to print the pattern (71) on the clothing (50).

The second step is to paste an alkaline solution (74) along the outer line (72-1) of the pattern (71-1) printed on the clothings (50) utilizing second stencil (20-1) as shown in the FIG. 3. The second stencil (20-1) may be the same as the first stencil (20) in the first step or has same pattern (71-2) with that (71) on the first stencil (20) but only the thickness (81) of the outer line (72-2) is different from the thickness (80) of the outer line (72) of the pattern (71) on the first stencil (20).

Figure 4:
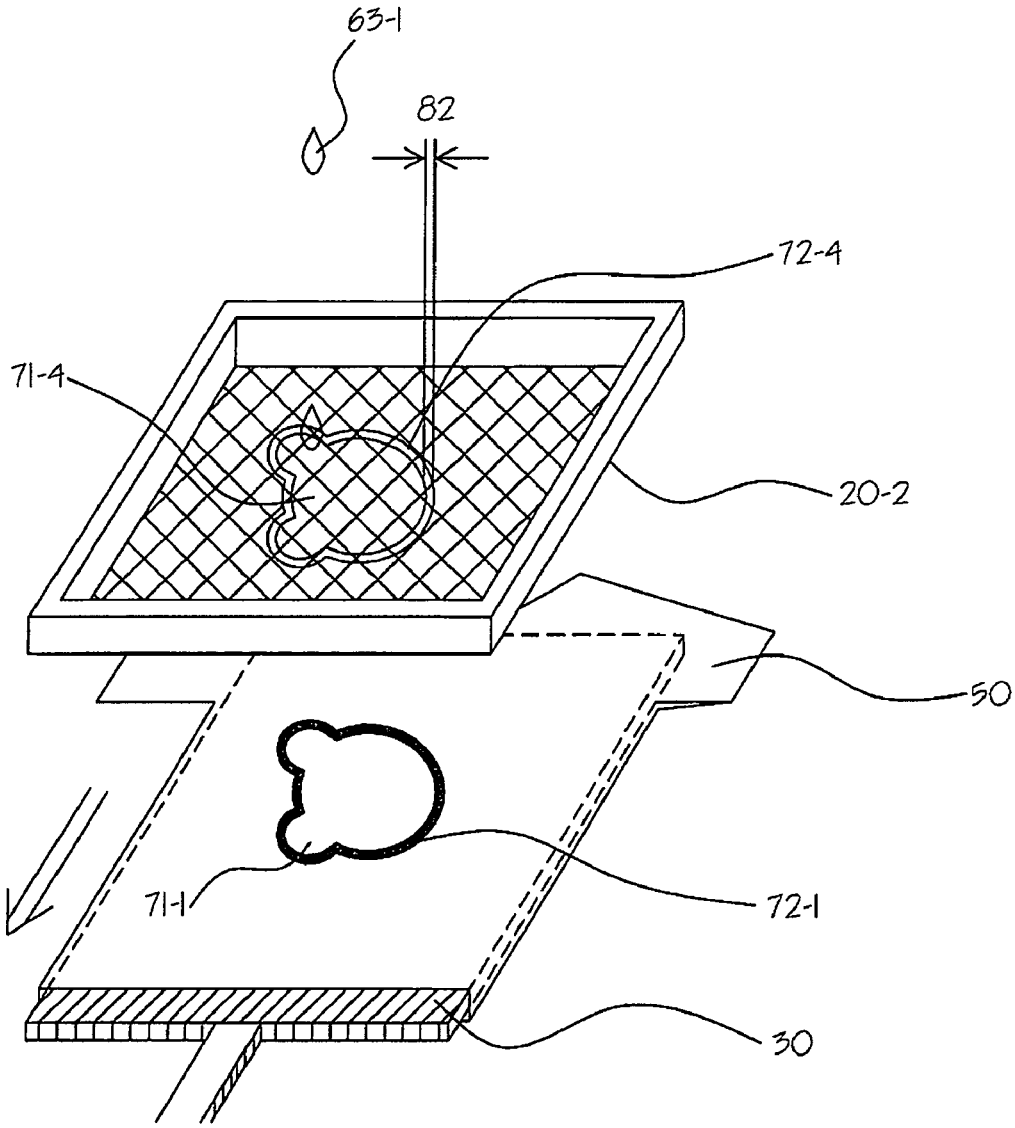
FIG. 4 is a schematic drawing showing pasting a grafting glue along the outer-line of the pattern printed on the clothing utilizing a third stencil according to current invention.
Figure 5:
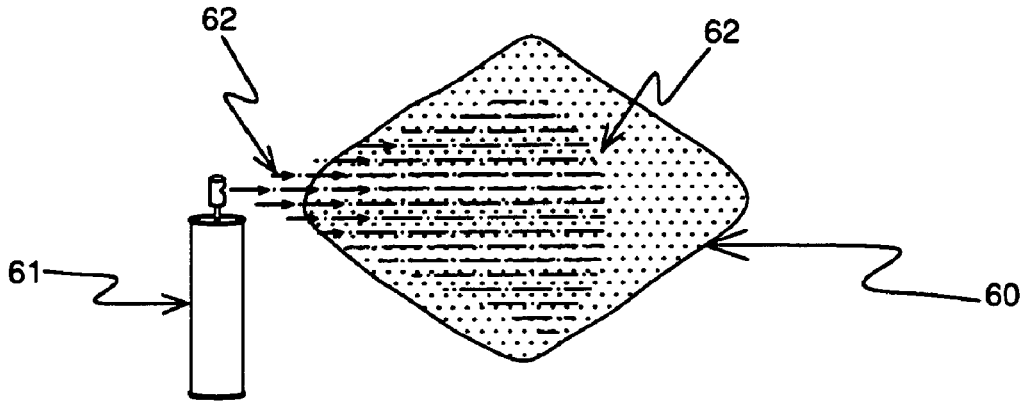
FIG. 5 is a schematic drawing showing spraying water soluble glue on a fabric's surface according to the current invention.
Figures 1, 6:
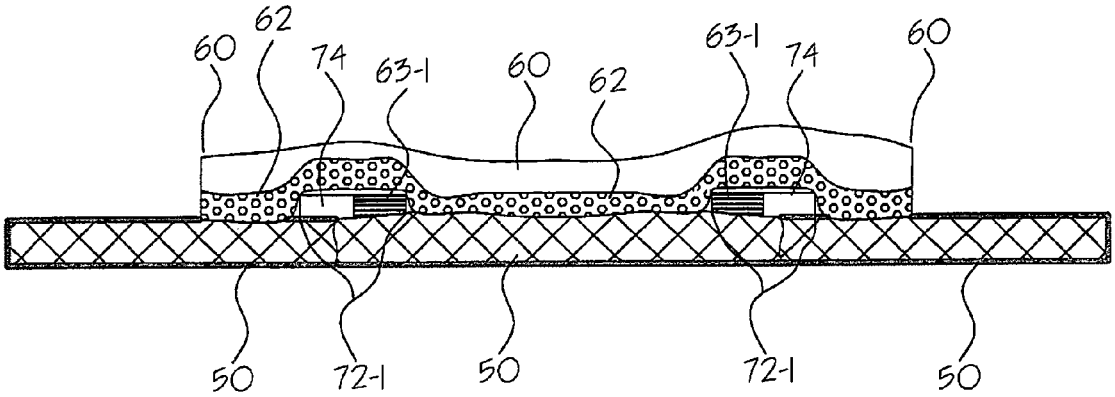
Figures 2, 6:
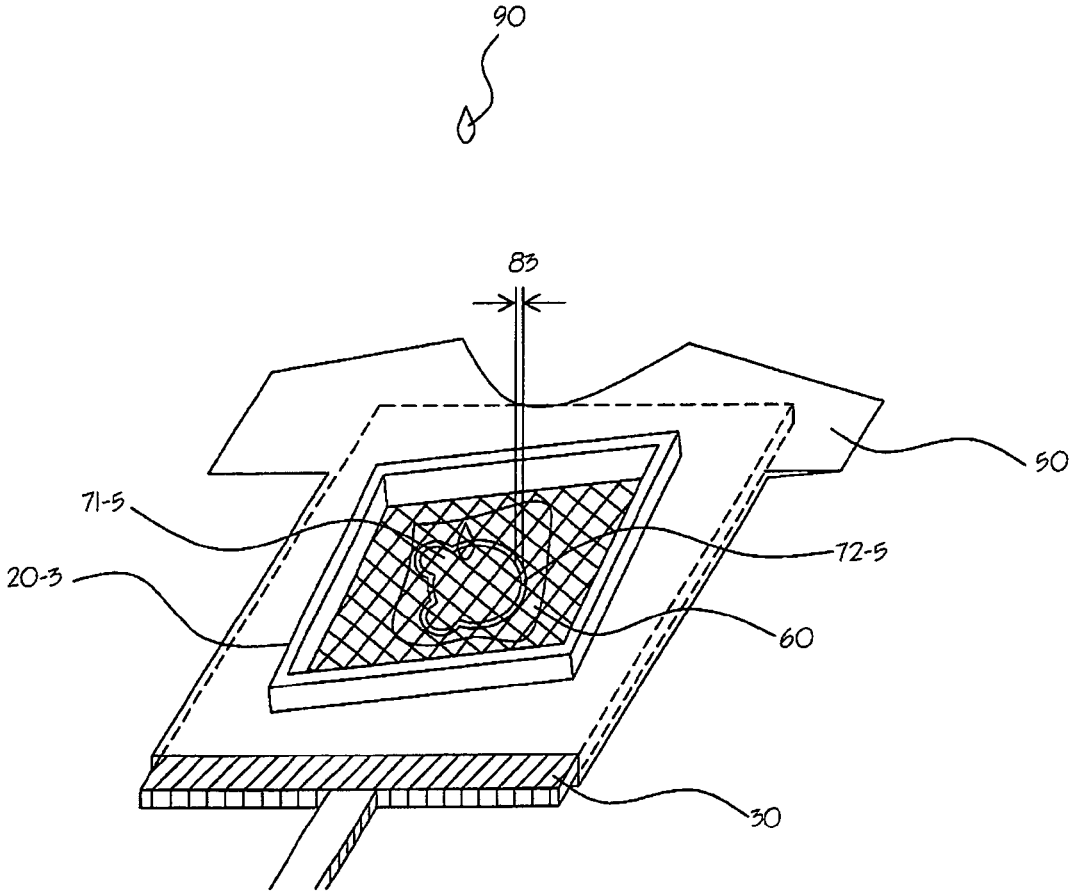

The third step is to paste a grafting glue (63-1) along the outer line (72-1) of the pattern (71-1) that is printed on the clothing (50) utilizing third stencil (20-2) as shown in the FIG. 4. In this step, the third stencil (20-2) may be same as one or two of the previous ones (20), (20-1) or has same pattern (71), (71-2), but the thickness (80-2) of the outer line (72-4) of the pattern (71-4) may be different from the former outer lines (72), (72-2 ). POLYONE S11111 SERIESONE®that contains 5% of fumed silica (CAS NO 112945-52-5for inhibitor and 95% of Chlorinated olefins of $C_{12}$-$C_{24}$ (CAS NO. 68527-02-6), from Polyone Corporation is used for the grafting glue (63-1). It contains 1 to 5% of fume silica as inhibitor. Therefore, the grafting glue (63-1) remains liquid before the glue (63-1) is heated above a certain temperature. The fourth step is to paste a water-soluble glue (62) on a fabric (60) as shown in the FIG. 5. The fabric (60) is made of, including but not limited to 100% cotton. The size of the fabric (60) is at least two times larger than the size of the pattern (71-1) printed on the clothing (50). The water-soluble glue (62) is starch glue solution bottled in a spray can (61). The water-soluble glue (62) is sprayed over whole area of one side of the fabric (60). The fabric (60) may be an artificial fabric such as polyester, etc. FIG. 6-1 shows the cross sectional view of the overlapped layer of the fabric (60) and the clothing (50).

The fifth step is to paste burn out gel (90) on fourth stencil (20-3) as shown in FIG. 6-2. The burnout gel (90) is a mixture of 15 wt % of natural alginate (CAS No. 9005-32-7), 50 wt % of PRINTGEN®OP-30PS (Mixture of Hydroxy Propyl Guar Gum, CAS No. 39421-75-5, 75%+Sodium Sulphate, CAS No. 7757-82-6, 24%+4-Chloro-3-methylphenol, CAS No. 59-50-7, 1%), 7 wt % of glycerin and 18 wt % of water. The burn-out gel (90) passes through the out line (72-5), which is just a mesh screen, of the pattern (71-5) on fourth stencil (20-3) and burn out the fabric (60) along the out line (72-5) of the pattern (71-5) thereon. In this step, the fourth stencil (20-3) may be same as one of the previous ones (20), (20-1), (20-2) or has same pattern (71), (71-2), (71-4) but the thickness (83 ) of the outer line (72-5) of the pattern (71-5) may be different from the former outer lines (72), (72-2), (72-4).

Figure 7:
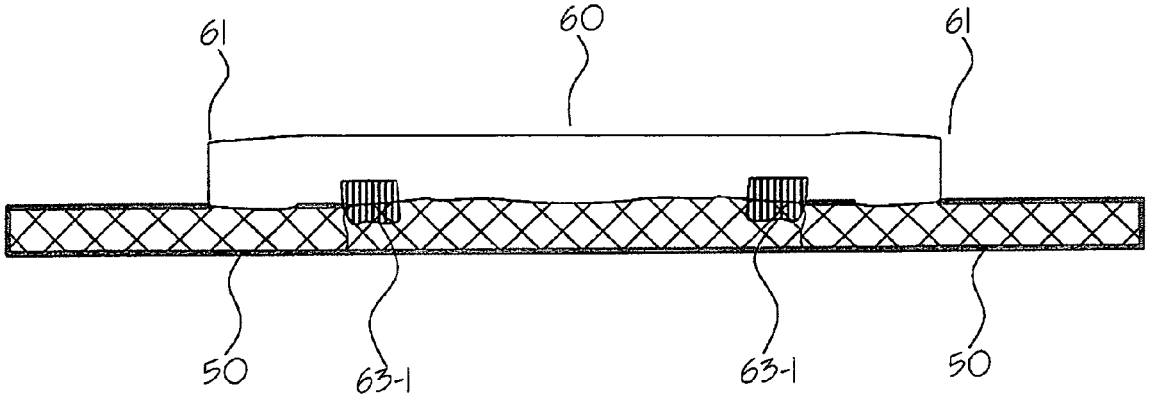
FIG. 7 is a schematic cross-sectional view of the overlapped clothing and the fabric showing the grafting glue smeared into the woven structure of the fabric and the clothing according to the current invention.

The sixth step is to take out the fabric (60) attached and the pattern (71-1) printed clothing (50) from the support plate (30) and dry on a dryer at 160° C. for longer than 2 minutes. In this step, the water-soluble glue (62) is dried out and the grafting glue (63-1) smeared into woven structure of the fabric (60) and the clothing (50) as shown in the FIG. 7. According to the Polyone's catalogue the Plastisols contains PVC (Polyvinylchloride) resins. Based on the material safety data sheet and catalogue of the Polyone corporation and Sugino, et al.'s U.S. Pat. No. 664', when the grafting (63-1) glue is pasted on the fabric (60) or on the clothing (50) at room temperature, it is sol-type oligomer. But, when heat is applied its viscosity is lowered first and penetrates and smeared into the clothing as shown in the FIG. 7.

Figure 8:
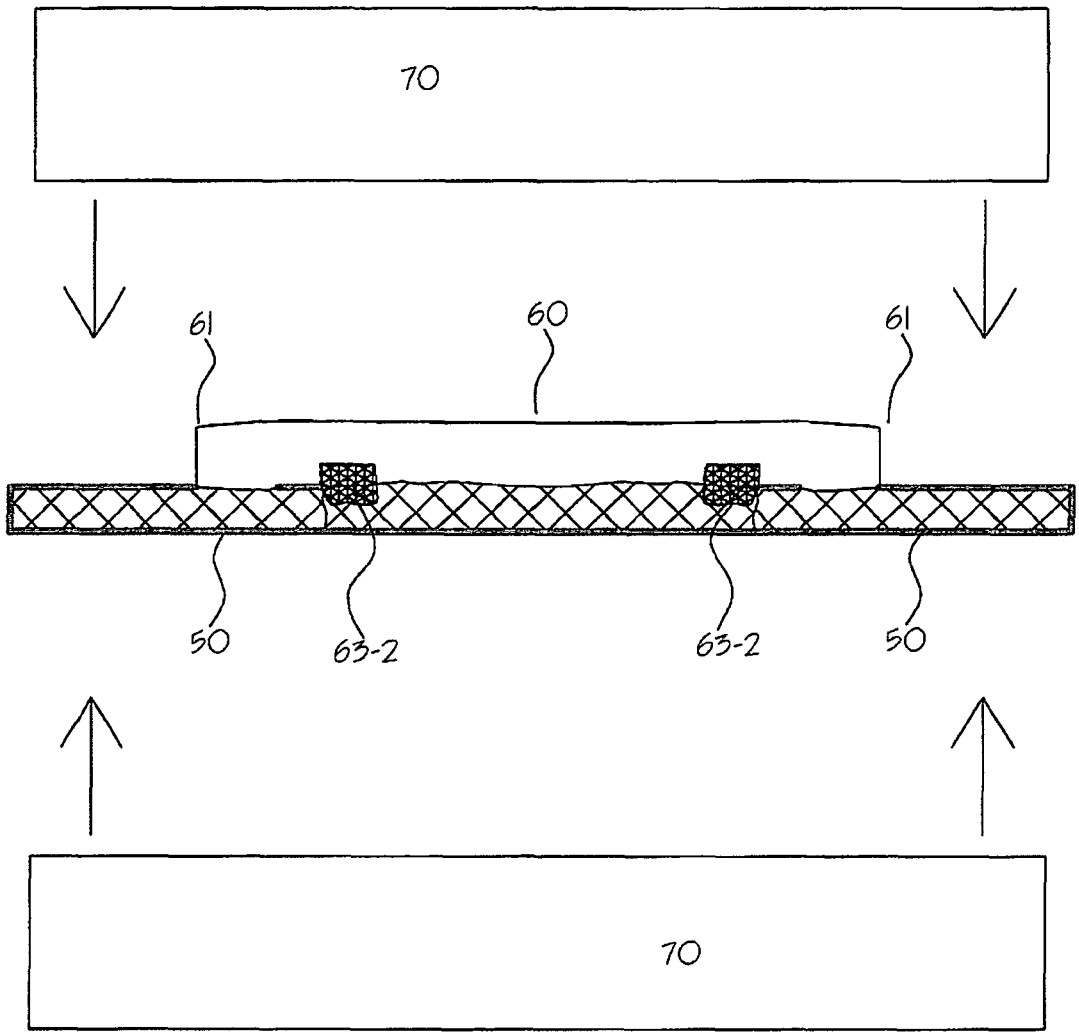
FIG. 8 is a schematic cross-sectional view of the overlapped clothing and the fabric showing the grafting glues starts grafting and become a grafted polymer according to the current invention.

The seventh step is to place the fabric (60) attached and the pattern (71) printed clothing (50), which was dried in the sixth step, between a heating press (70) and press for at least 5 seconds at 160° C. as shown in the FIG. 8. Now, the fabric (60) and the clothing (50) are strongly adhered by grafted polymer (63-2).

The left of the burn out from the grafted fabric (60) may be removed by water washing. In the water washing, marble washing may be applied to make the fabric (60) grafted clothing (50) look like used denim. For the above step, the clothes and fabric may be polyester, nylon and any other artificial fabrics.

Durability of the grafted fabric (60) on the clothing (50) is tested by laundering and drying repeatedly. Even after 100 times of machine laundering, the fabric (60) solidly attached to the clothing (50).

Among many different fabric and clothes, 100% cotton fabric and 100% cotton clothes showed the best results.

What is claimed is

1. A method of durably grafting a decorated fabric to a cotton clothing with stencils is comprised of;

first step of printing a pattern with a first stencil on a clothing that covers a supporting plate of an automatic printing machine, and second step of pasting an alkaline solution along an outer line of the pattern printed on the clothing utilizing a second stencil, and third step of pasting a grafting glue that contains 5% of fumed silica (CAS NO 112945-52-5) for inhibitor and 95% of Chlorinated olefins of $C_{12}$-$C_{24}$ (CAS NO. 68527-02-6) along the outer line of the pattern that is printed on the clothing with a third stencil, fourth step of spraying water-soluble glue of starch glue solution in a spray can on one side of a whole area of a fabric that is at least two times larger than the size of the pattern that is printed on the clothing, and fifth step of pasting a burn out gel, which is a mixture of 15 wt % of natural alginate (CAS No. 9005-32-7), 50wt % mixture of (Hydroxy Propyl Guar Gum, CAS No. 39421-75-5 ,75% +Sodium Sulphate, CAS No. 7757-82-6, 24% +4-Chloro-3-methylphenol, CAS No. 59-50-7, 1%), 7 wt % of glycerin and 18wt % of water, on a fourth stencil that is overlapped on the clothing having the attached fabric, sixth step of taking out the clothing having the attached fabric and the printed pattern from the supporting plate of the automatic printing machine and drying on a dryer at 160° C. for 3 minutes to allow the water-soluble glue to be dried out and the grafting glue smeared into a woven structure of the fabric and the clothing, and seventh step of placing the clothing having the attached fabric and the printed pattern between a heating press and pressing for 5 seconds at 160° C. to allow the grafting glue become a grafted polymer.

2. A method of durably grafting a decorated fabric to a clothing with stencils in claim 1, wherein the second stencil has the same pattern as that on the first stencil except that only the thickness of the outer line is different from the thickness of an outer line of the pattern on the second stencil.

3. A method of durably grafting a decorated fabric to a clothing with stencils in claim 1, wherein the third stencil has the same pattern as that on the second stencil except that only the thickness of the outer line is different from the thickness of outer line of the pattern on the third stencil.

4. A method of durably grafting a decorated fabric to a clothing such with stencils in claim 1, wherein the fourth stencil has the same pattern as that on the third stencil except that only the thickness of the outer line is different from the thickness of an outer line of the pattern on the fourth stencil.

5. A method of durably grafting a decorated fabric to a clothing with stencils in claim 1, wherein the fabric is made of 100% cotton.

6. A method of durably grafting a decorated fabric to a clothing with stencils in claim 1, wherein the clothing is made of 100% cotton.

7. A method of durably grafting a decorated fabric to a clothing with stencils in claim 1, wherein the fabric is made of polyester.

8. A method of durably grafting a decorated fabric to a clothing with stencils in claim 1, wherein the clothing is made of polyester.

* * * * *